US005210678A

United States Patent [19]

Lain et al.

[11] Patent Number: 5,210,678

[45] Date of Patent: May 11, 1993

[54] CHAIN-TYPE DISCHARGE WIRE FOR USE IN AN ELECTROSTATIC PRECIPITATOR

[75] Inventors: Yeong-Chang Lain; Rey-Chein Chang; Ching-I Juch, all of Hsinchu, Taiwan

[73] Assignee: Industrial Technology Research Institute, Taiwan

[21] Appl. No.: 807,711

[22] Filed: Dec. 16, 1991

[51] Int. Cl.[5] ..... B03C 3/41; H01J 27/22; H01T 19/04; H01T 23/00

[52] U.S. Cl. ..... 361/226; 55/152; 250/324; 250/423 R; 361/231; 422/186.04

[58] Field of Search ..... 361/225–228, 361/230–232; 250/324–326, 423 R, 424, 423 F; 422/186.04, 186.1; 55/150–152, 136, 123, 139

[56] References Cited

U.S. PATENT DOCUMENTS 3,649,830 3/1972 Sato et al. ..... 250/326
4,388,677 6/1983 Saurenman ..... 361/231
4,693,869 9/1987 Pfaff ..... 422/186.04
4,879,100 11/1989 Tsutsui et al. ..... 250/324
5,038,036 8/1991 Kouguchi et al. ..... 250/324

*Primary Examiner*—A. D. Pellinen
*Assistant Examiner*—Richard T. Elms
*Attorney, Agent, or Firm*—Rodman & Rodman

[57] ABSTRACT

An improved discharge wire for use in an electrostatic precipitator which is used for collecting pollutant particles contained in a flow of exhaust gas. The improved discharge wire is a chain having a plurality of chain links made of conductive material. There is provided at least one needle-like member made of conductive material on at least one of the chain links. As an electric potential is applied to the chain, the needle-like member emits corona current. The corona current charges the pollutant particles such that the pollutant particles are forced by the electric field to a collecting member.

1 Claim, 5 Drawing Sheets

CHAIN-TYPE DISCHARGE WIRE FOR USE IN AN ELECTROSTATIC PRECIPITATOR

FIELD AND BACKGROUND OF THE INVENTION

1. Field of the Invention

The present invention relates in general to a discharge wire for use in an electrostatic precipitator used for collecting pollutant particles contained in an exhaust gas flow. In particular, the discharge wire is a chain having a plurality of needle-like members provided thereon.

2. Description of Prior Art

To protect the environment, factory facilities which produce exhaust gases containing a large amount of smoke and dust are generally opposed by environmentalists. Therefore an electrostatic precipitator (ESP) is installed at the exhaust gas outlet for collecting the pollutant particles contained in the exhaust gas before the exhaust gas is released into the atmosphere.

Referring to FIG. there is shown a schematic illustration of an electrostatic precipitator 10. The electrostatic precipitator 10 comprises a pair of collecting plates 12 arranged in parallel to each other and a discharge wire 20 disposed between the pair of collecting plates 11, 12. In the illustrated exemplary electrostatic precipitator, three such arrangements are disposed along the exhaust gas passage.

The conventional structure of the discharge wires 20 is shown in FIG. 2, which is an angle bar having a plurality of pikes 21 formed at the edges thereof.

The conventional discharge wires 20 are connected to the negative electrode 31 of a DC potential 30 and the collecting plates 11, 12 are connected to the positive electrode 32 of the same such that an electric potential is directed from the collecting plates 11, 12 to the conventional discharge wires 20. The collecting plates 11, 12 are further connected to the ground. The electric field established between the collecting plates 11, 12 and the discharge wire 20 is shown in FIG. 3.

The electric potential thus applied should be large enough to cause corona currents at the tips of the pikes 21. The corona currents are basically beams of electrons discharged at high velocities from the tips of the pikes 21 to the collecting plates 11, 12.

As the rapidly moving electrons which have been discharged from the discharge wire 20 encounter air molecules, the air molecules are ionized, thereby creating positively charged air molecules and more free drifting electrons. The positively charged air molecules are attracted by the electric field and move toward the discharge wire 20. At the same time, the electrons are forced by the electric field to move toward the collecting plates 11, 12.

When the pollutant particles pass through the space between the collecting plates 11, 12, the corona current imparts negative charges to the pollutant particles. These negatively charged particles are then attracted to the collecting plates 11, 12 which are positively charged. The collected pollutant particles will accumulate to a thick layer of agglomeration. By applying mechanical rapping to the collecting plates, the thick layer of agglomeration can be removed to be collected by the collection buckets 40 which are placed below the collecting plates 11, 12.

Since most of the pollutant particles contained in the exhaust gas have been collected by the collecting plates 11, 12, what exits from the electrostatic precipitator 10 is substantially a gas flow without smoke or dust.

The above described electrostatic precipitator which utilizes the conventionally structured discharge wire has a high particle-collecting efficiency (more than 99%) and is also easy to maintain. However, since the electrostatic precipitator requires a high electric potential (about 30–40 Kilovolt) to generate the corona current, the costs for electric energy are normally quite high.

SUMMARY OF THE INVENTION

It is therefore a primary object of the present invention to provide an improved discharge wire for use in the electrostatic precipitator such that the operation of the electrostatic precipitator consumes less electric energy than that employing the conventional discharge wire.

It is another object of the present invention to provide a discharge wire for the electrostatic precipitator, which allows the same to perform particle-collecting with high efficiency.

In accordance with the above objects, there is provided an improved discharge wire for use in the electrostatic precipitator. The improved discharge wire is basically a chain having a plurality of chain links made of conductive material. There is provided at least one needle-like member made of conductive material on at least one of the chain links.

The electrostatic precipitator utilizing the discharge wire according to the present invention consumes an average of 30% less electric energy than that needed by utilizing the conventional discharge wire to achieve the same particle-collecting efficiency.

BRIEF DESCRIPTION OF THE DRAWINGS

The present invention can be more fully understood by a reading to the subsequent detailed description of the preferred embodiments with references made to the accompanying figures, wherein.

DETAILED DESCRIPTION OF THE PREFERRED EMBODIMENTS

Figure 4:
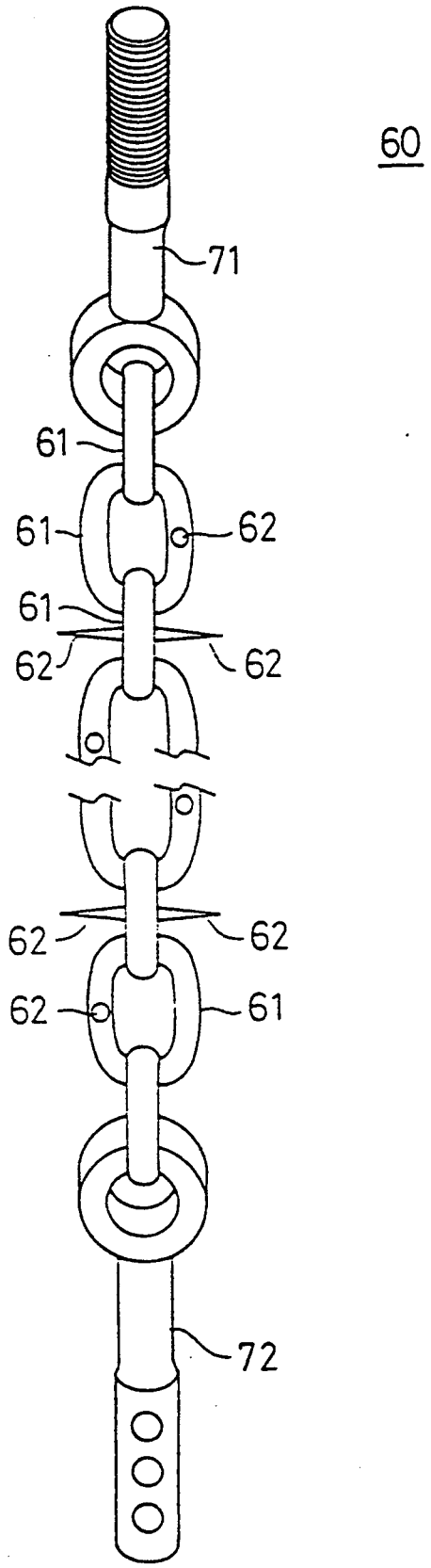
FIG. 4 shows a discharge wire in accordance with the present invention.
Figure 5:
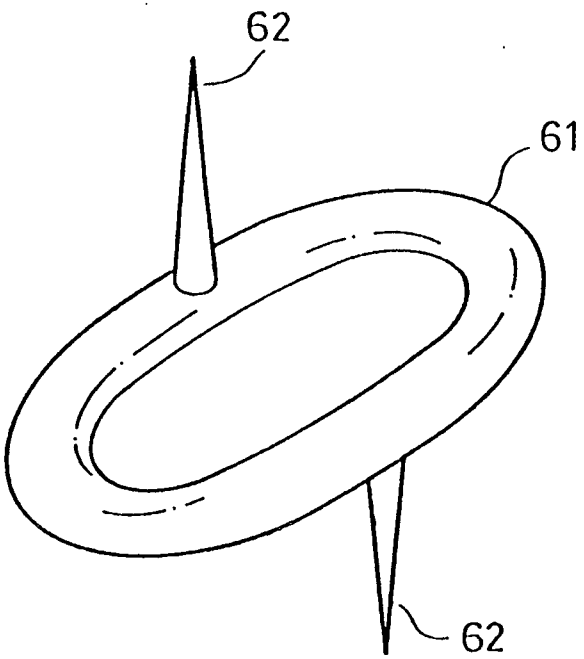
FIG. 5 shows an enlarged view of a chain link of the discharge wire shown in FIG. 4.

Referring to FIG. 4, there is shown a discharge wire 60 structured in accordance with the present invention. The discharge wire 60 is essentially a chain having a plurality of chain links 61. As shown in the enlarged view of FIG. 5, each of the chain links 61 is provided with a pair of needle-like members 62 which protrude in the opposite directions. And the other end of the chain is provided with a screw member 71 with which the discharge wire 60 can be fastened to hang down between the collecting plates 11, 12.

Figure 1:
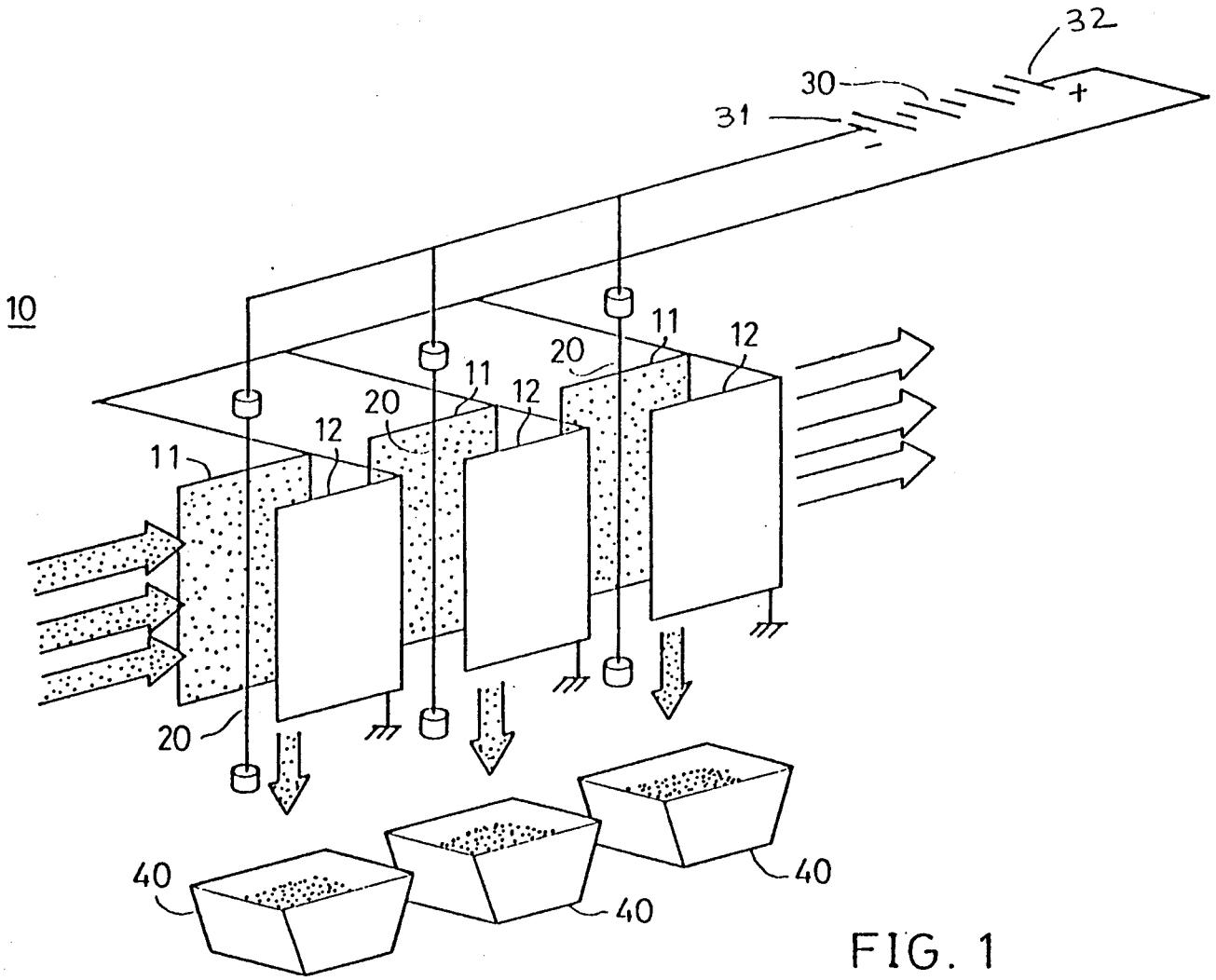
FIG. 1 (PRIOR ART)
FIG. 1 is a schematic perspective illustration of an electrostatic precipitator.
Figure 2:
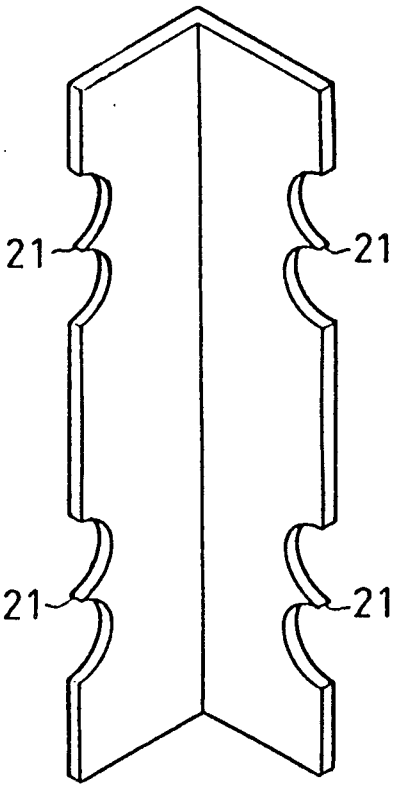
FIG. 2 (PRIOR ART)
FIG. 2 shows a conventional discharge wire.
Figure 3:
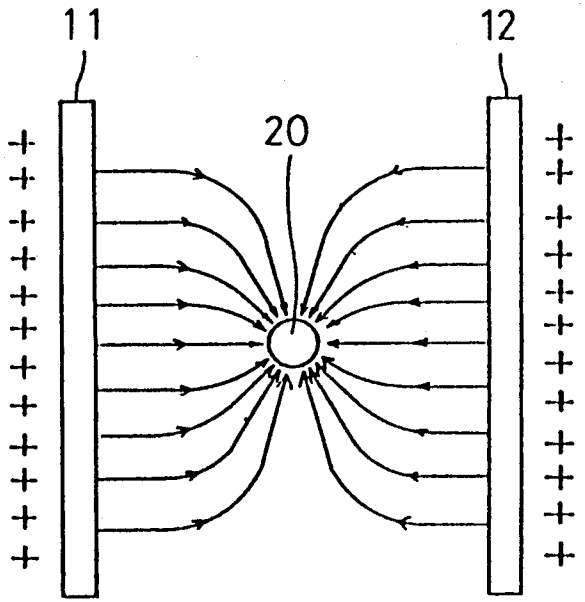
FIG. 3 (PRIOR ART)
FIG. 3 is a schematic illustration, showing the electric field established within the electrostatic precipitator of FIG. 1.

The discharge wire 60 according to the present invention is to replace the conventional discharge wire 20 in the electrostatic precipitator 10 of FIG. 1. The subsequent description will be directed to the tests for the particle-collecting efficiency of the discharge wire 60 according to the present invention and the conventional discharge wire 20.

The particle-collecting efficiency is defined as:

$$\mu = \left(1 - \frac{Co}{Ci}\right) \times 100\% \quad (1)$$

where $\mu$ is the particle-collecting efficiency (%),

Ci is the concentration (g/m$^3$) of pollutant particles contained in the exhaust gas flowing into the electrostatic precipitator, and Co is the concentration (g/m$^3$) of pollutant particles contained in the exhaust gas flowing out of the electrostatic precipitator.

The theoretical relationship for the particle-collecting efficiency has been derived as:

$$\mu = 1 - \exp\left(-\frac{A}{Q} * W\right), \quad (2)$$

and $$W = \frac{Eo * Ep * a}{2 * \pi * v} \quad (3)$$

where

A is the area of collection (m$^2$),

Q is the flow rate of exhaust gas (m$^3$/sec),

W is the migration velocity of charged pollutant particles (m/sec),

Eo is the magnitude of the onset electric field (KV/m),

Ep is the magnitude of the electric field at the collecting plate (kV/m), v is the viscosity of air (poise), and a is the average radius of pollutant particles (m).

In accordance with Equations (2) and (3), increasing the magnitude of the electric fields $E_0$, Ep will increase the migration velocity W and thus the particle-collecting efficiency $\mu$.

Figure 6:
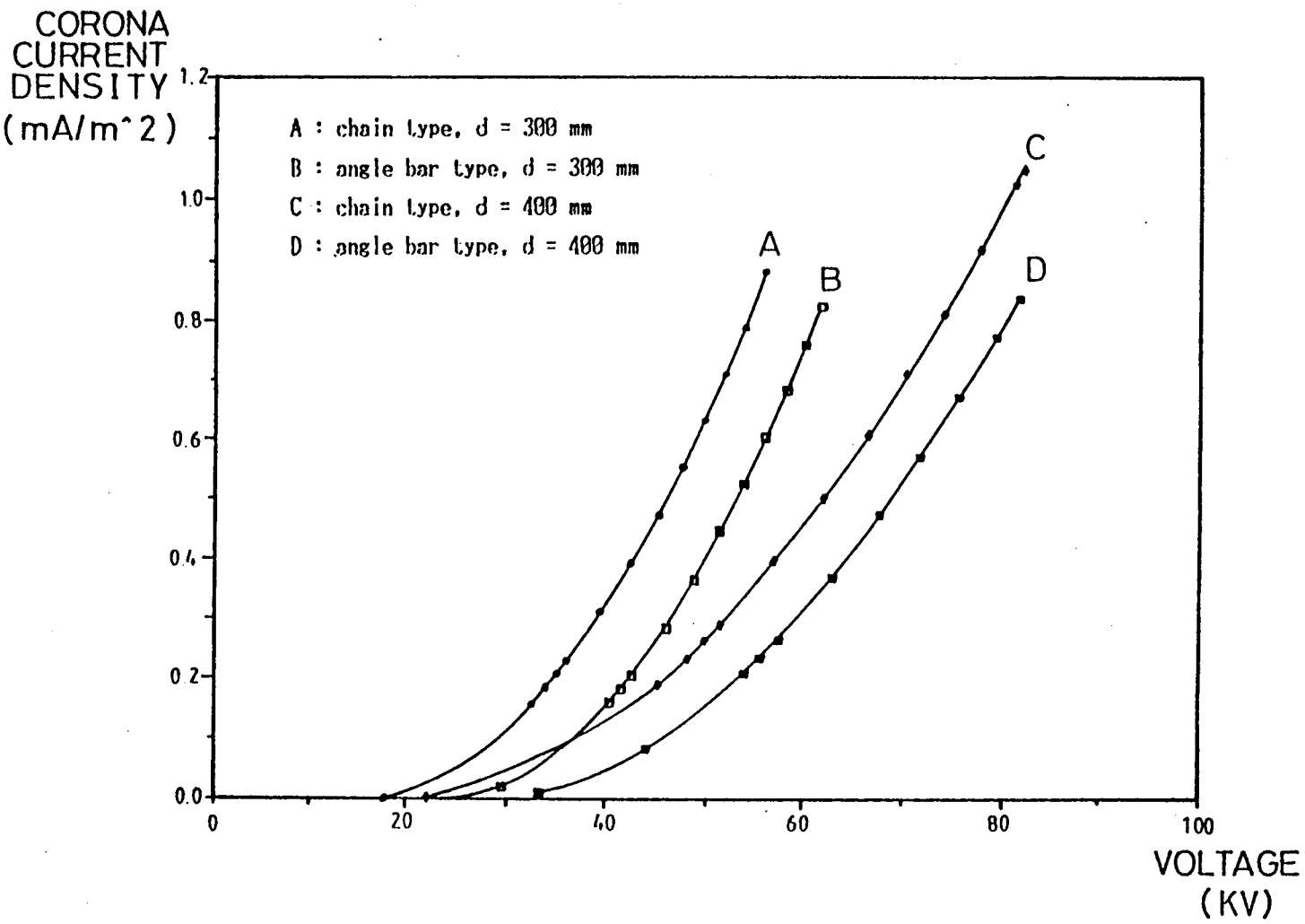
FIG. 6 is a graphical representation, showing the corona current characteristics of the discharge wire according to the present invention and that of the conventional discharge wire.

The characteristic of the corona current density Ic discharged from the discharge wire according to the present invention in response to the electric potential Vp is shown in the graph of FIG. 6 along with that of the conventional discharge wire. From the characteristic curves, it can be clearly seen that if the same magnitude of electric potential is applied across the discharge wire to the collecting plate, the discharge wire according to the present invention will discharge a larger magnitude of corona current density.

The particle-collecting efficiency and the amount of energy consumption for the discharge wire according to the present invention and the conventional discharge wire are measured. The measurements were directed with a discharge wire according to the present invention and a conventional discharge wire whose specifications are shown in Table 1 below.

TABLE 1

| Discharge Wire Type | Width | Distance between two discharge wire in the ESP | Distance between two adjacent discharging points* | Number of discharging points |
|---|---|---|---|---|
| Angle Bar | 20 mm | 195 mm | 95 mm | 3168 |
| Chain | 25 mm | 195 mm | 76 mm | 3808 |

*Tuft

The measurements have been done in two separate electrostatic precipitators, one with d=300 mm, and the other with d=400mm, where d is the distance between the collecting plates (a larger d means a larger electric potential needed to initiate the corona current). The results are given in Table 2 below.

TABLE 2

| | particle-collecting efficiency (%) | potential (KV) | exhaust gas flow rate (m$^3$/hr) | energy consumption (watts) | energy consumption per unit of flow rate (watts/m$^3$/sec) |
|---|---|---|---|---|---|
| d = 300 mm | | | | | |
| conventional | 99.9 | 34.8 | 5359 | 697 | 468 |
| present invention | 99.8 | 30.0 | 5270 | 524 | 358 |
| d = 400 mm | | | | | |
| conventional | 99.9 | 46.0 | 5375 | 961 | 463 |
| present invention | 99.8 | 33.9 | 5316 | 533 | 361 |

Comparing the data in Table 2, the electrostatic precipitator utilizing the discharge wire according to the present invention consumes 31% less electric energy for d=300 mm and 28% less electric energy for d=400 mm than that needed by utilizing the conventional discharge wire to achieve the same particle-collecting efficiency.

It is to be understood that various modifications can be made to the above-described preferred embodiment of the present invention. Therefore, the spirit and scope of the present invention is recited in the following appended claims.

What is claimed is:

1. A discharge wire for use in an electrostatic precipitator which is used for collecting pollutant particles contained in a flow of exhaust gas, the electrostatic precipitator having a collecting member made of conductive material and a means for impressing an electric field across said discharge wire and the collecting member;, said discharge wire comprising:

a chain having a plurality of chain links made of conductive material, said chain being disposed near said collecting member;

at least one needle-like member made of conductive material provided on at least one of the chain links; and wherein as the electric field is impressed across said chain and the collecting member, said needle-like member will discharge corona current such that pollutant particles nearby are charged and thereby attracted by and accumulated on the collecting member.

* * * * *